US007261260B2

(12) United States Patent
Tan

(10) Patent No.: US 7,261,260 B2
(45) Date of Patent: Aug. 28, 2007

(54) GOLF BAG BOTTOM

(76) Inventor: Fu-Hsing Tan, Zao Er Industrial District, Wentang town, Dongcheng, Dong Guan (CN) 511700

( * ) Notice: Subject to any disclaimer, the term of this patent is extended or adjusted under 35 U.S.C. 154(b) by 12 days.

(21) Appl. No.: 10/976,113

(22) Filed: Oct. 28, 2004

(65) Prior Publication Data

US 2006/0006293 A1 Jan. 12, 2006

(30) Foreign Application Priority Data

Jul. 12, 2004 (CN) ..... 2004 2 0071398X

(51) Int. Cl.
*A63B 55/04* (2006.01)

(52) U.S. Cl. ..... 248/97; 248/96; 206/315.6

(58) Field of Classification Search ..... 248/97, 248/99, 95, 96; 206/315.6, 315.3, 315.7
See application file for complete search history.

(56) References Cited

U.S. PATENT DOCUMENTS 1,600,601 A * 9/1926 Sampson ..... 206/315.2
2,502,627 A * 4/1950 Martin ..... 206/315.6
2,751,955 A * 6/1956 Nahon ..... 206/315.6
4,130,153 A * 12/1978 Zopf ..... 206/315.6
4,667,820 A * 5/1987 Solheim ..... 206/315.6
4,858,761 A * 8/1989 Fumia ..... 206/315.3
4,860,889 A * 8/1989 Lemieux et al. ..... 206/315.6
5,209,350 A * 5/1993 Maeng ..... 206/315.7
5,901,845 A * 5/1999 Cheng ..... 206/315.7
5,996,789 A * 12/1999 Suggs et al. ..... 206/315.3
6,216,865 B1 * 4/2001 Maeng ..... 206/315.6

* cited by examiner

*Primary Examiner*—Carl D. Friedman
*Assistant Examiner*—Tan Le
(74) *Attorney, Agent, or Firm*—Pro-Techtor Int'l Services

(57) ABSTRACT

A golf bag bottom of the present invention includes a bottom base and a side frame. The bottom base has a transitional part; and the side frame is divided into two parts by the transitional part, and a notch is formed at a connection portion between the two parts of the side frame. The transitional part is formed on a ¼ position of the golf bag bottom along a longitudinal direction.

8 Claims, 4 Drawing Sheets

GOLF BAG BOTTOM

CROSS-REFERENCE TO RELATED APPLICATION

The present invention claims priority of Chinese application serial No. 200420071398X, filed on Jul. 12, 2004.

FIELD OF THE INVENTION

The present invention is related to golf bags, and more particularly to a golf bag bottom.

BACKGROUND OF THE INVENTION

At present, a conventional golf bag generally comprises a top frame 03, a bag body 01, a golf bag bottom 02, a plurality of support brackets 05, a pair of steel wires 04, and a movable tongue block 24, as shown in FIGS. 1(*a*) and 1(*b*). The golf bag bottom 02 generally has an inclined plane with the moveable tongue block 24 thereon. During operation, when the golf bag is placed slantways, the support brackets 05 are unfolded to pull the steel wires 04, and then the tongue block 24 is driven by the steel wires 04 to slant the golf bag bottom 02.

However, under the circumstance, the traditional golf bag cannot keeps stable, even being overturned, because of a small contacting area of the golf bag bottom 02 with the ground and heavy golf clubs contained therein. In addition, because the traditional golf bag bottom 02 is formed by assembling a lot of components together, so the manufacturing process will become rather complicated and also results in an expensive manufacturing cost and inefficiency.

Hence it is desired to provide a golf bag bottom which can overcome the foregoing drawbacks of the prior art.

SUMMARY OF THE INVENTION

A main object of the present invention is to provide a simple, cheap golf bag bottom which can keep golf bag stable when being positioned slantways.

To achieve the above-mentioned object, a golf bag bottom of the present invention comprises a bottom base and a side frame. The bottom base has a transitional part; and the side frame is divided into two parts by the transitional part, and a notch is formed at a connection portion between the two parts of the side frame.

A golf bag of the present invention comprises a top frame; a bag body; a support stand; a pair of external support springs; and a golf bag bottom. The golf bag bottom comprises a bottom base and a side frame; wherein the bottom base has a transitional part; and the side frame is divided into two parts by the transitional part, and a notch is formed at a connection portion between the two parts of the side frame.

Comparing with the prior art, the golf bag bottom has an enough contact area with the ground so as to keep the golf bag stable. In addition, because the bottom base has an elastic transitional part, the support stand of the golf bag can be folded and unfolded. Furthermore, the golf bag bottom of the present invention has only a few components, so it has a simple structure and easily assembled, accordingly, the cost and time of manufacturing the golf bag bottom and golf bag is reduced greatly.

Comparing with the prior art, the golf bag bottom has an enough contact area with the ground so as to keep the golf bag stable. In addition, because the bottom base has an elastic transitional part, the support bracket of the golf bag can be folded and unfolded. Furthermore, the golf bag bottom of the present invention has only a few components, so it has a simple structure and easily assembled, accordingly, the cost and time of manufacturing the golf bag bottom and golf bag is reduced greatly.

For the purpose of making the invention easier to understand, some particular embodiments thereof will now be described with reference to the appended drawings in which:

DETAILED DESCRIPTION OF THE INVENTION

Figure 1B:
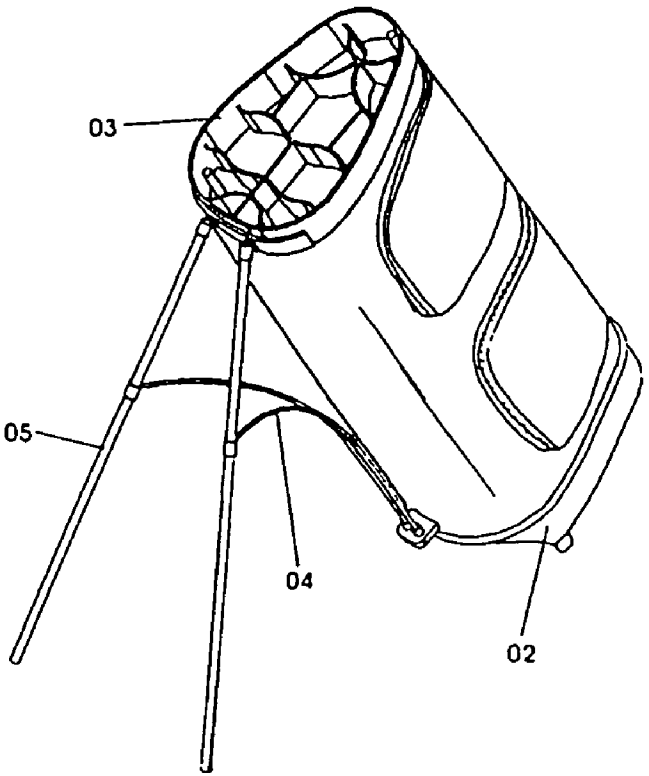
FIGS. 1(*a*) and 1(*b*) is a schematic, perspective view of a traditional golf bag when being positioned slantways and vertically.
Figure 1A:
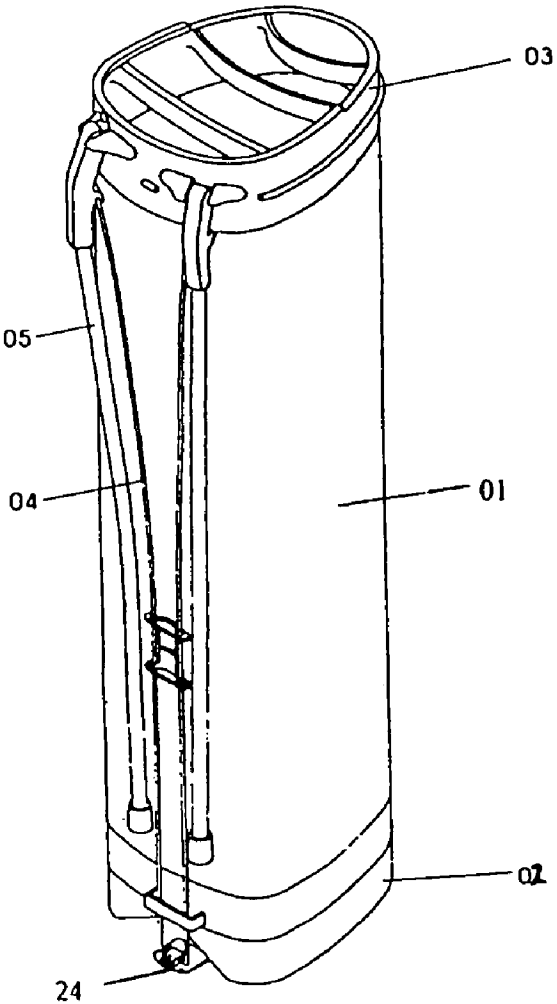
Figure 3:
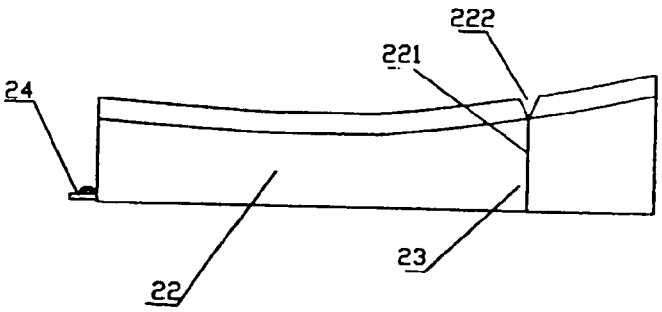
FIG. 3 is another plan view of the golf bag bottom of FIG. 2 according to another angle of view.
Figure 2:
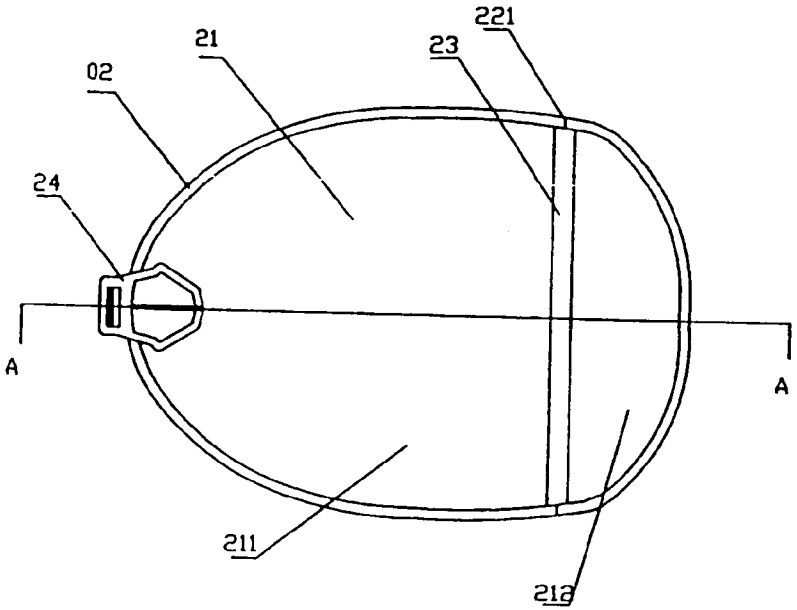
FIG. 2 is a plan view of a golf bag bottom of the present invention.
Figure 4:
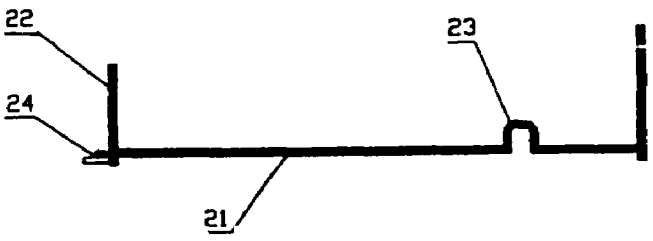
FIG. 4 is a cross-sectional view of FIG. 2 taken along line A-A.
Figure 6:
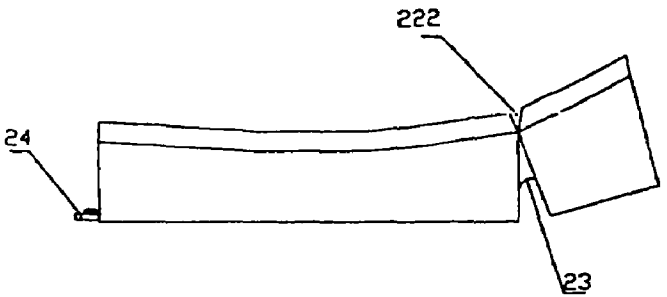
FIG. 6 is a schematic view of the golf bag bottom shown in FIG. 5.

Referring now to the drawings in detail, FIGS. 2-6 shows a golf bag bottom and a golf bag with the golf bag bottom according to an embodiment of the present invention. The golf bag bottom 02 comprises a bottom base 21 and a side frame 22, as shown in FIGS. 2 and 3. The bottom base 21 is consisted of two parts 211, 212, the two parts 211, 212 are connected with a transitional part 23 so as to form a whole bottom plane, as shown in FIG. 4. As an embodiment, the transitional part 23 is U-shaped and made of elastic material. The side frame 22 is divided into two parts by the transitional part 23 of the bottom base 21. The two parts of the side frame 22 are connected at a connection portion 221. In addition, a V-shaped notch 222 is formed on a position above the connection portion 221 at which the side frame 22 is connected with a bag body 01 of golf bag (best see FIG. 5). As an embodiment of the invention, the golf bag bottom 02 is made of plastic material. Then, the two parts 211, 212 of the golf bag bottom 02 can be bent oppositely and return back to their original positions under action of the elastic force producing from the transitional part 23, see FIG. 6. In the present invention, the transitional part 23 can be integrally formed with the bottom base 21, or adhered to the two parts 211, 212 of the bottom base 21 by its two end rims.

Referring to FIGS., 2-6, in a further embodiment, the transitional part 23 can be formed on a ¼ position of the golf bag bottom 02 along a longitudinal direction. Then, when the support stands 05 are unfolded, the parts 211 of the bottom base 21 contacts with the ground, that is, the golf bag bottom 02 has its 3/4 of bottom plane area contacting with the ground, so that not only keep the golf bag more stable, but also assure enough elastic force producing from the transitional part 23.

Figure 5:
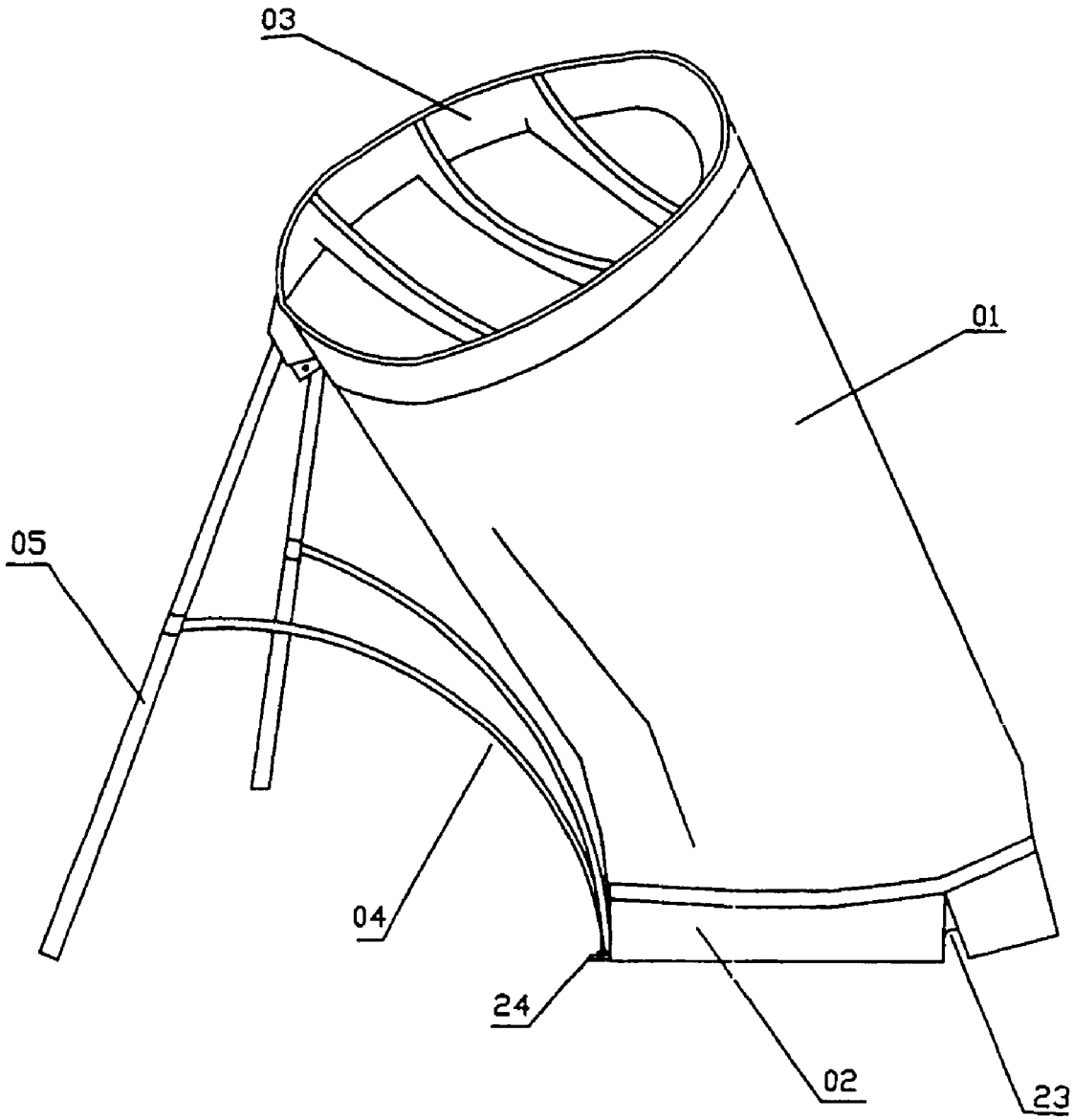
FIG. 5 is a perspective view of a golf bag with the golf bag bottom of FIG. 2 which is positioned slantways.

Referring to FIG. 5, it shows a golf bag having the golf bag bottom 02 of the invention. The golf bag also comprises a top frame 03, a bag body 01, a golf bag bottom 02, a support stand 05, a pair of external support springs 04, and a movable tongue block 24. During operation, when pushing the golf bag forwardly, the transitional part 23 of the bottom base 21 will be compressed so that two parts 211, 212 of the bottom base 21 are separated with each other at the transitional part 23. That is, the part 211 will rotate about the transitional part 23 as an axis, and then pull the external support springs 04 to unfold the support stand 05. At the same time, the part 212 will move upwards to leave the ground and make the V-shaped notch 222 of the side frame 22 become smaller. The rotation of the part 211 can be changed according to certain ground conditions so as to assure the golf bag bottom 02 having a largest contact area with the ground. When recovering the golf bag to its original position, it is only required to lift up the golf bag, and then the golf bag bottom 02 will come back its original position and drive the steel-wife external support spring 04 to fold the support stand 05.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A golf bag bottom comprising:

a first bottom base having an open top and one open side, formed of a first bottom portion having a substantially planar lower end face suitable for being placed on a ground, a first side frame extending vertically from the peripheral edge of said first bottom portion, partially enclosing said first bottom portion to form the open top and the one open side thereof, the side frame at the juncture of the top with the open side having corners beveled away from the open side;

a second bottom base having an open top and one open side, formed of a second bottom portion having a substantially planar lower end face suitable for being placed on the ground, a second side frame extending vertically from the peripheral edge of said second bottom portion, partially enclosing said second bottom portion to form the open top and the one open side thereof, the top corners of said second side frame at the open side being beveled away from the open side; and a transitional part, directly coupling said first and second bottom portions together at the open sides respectively, adapted to allow separation between said first and second bottom portions, whereby said second bottom portion may be angled with respect to said first bottom portion;

wherein said beveled corners of said first side frame and said second side frame form a notch on each end of the open sides, each apex of said notches acting as a hinge point thereby defining a horizontal pivot axis elevated above said first bottom portion, whereby a golf bag attached to said golf bag bottom may be reclined from the vertical with said first bottom portion placed on the ground and said second bottom portion forming an acute angle to the ground.

2. The golf bag bottom as claimed in claim 1, wherein the transitional part is formed on a ¼ position of the golf bag bottom along a direction transverse to said transitional part.

3. The golf bag bottom as claimed in claim 1, wherein the transitional part is formed of one-piece with said first bottom base and said second bottom base.

4. The golf bag bottom as claimed in claim 2, wherein the transitional part is bonded with said first and second bottom portions of the bottom bases by adhesive.

5. The golf bag bottom as claimed in claim 4, wherein the transitional part is U-shaped and made of elastic material.

6. The golf bag bottom of claim 1, wherein said first bottom base further comprises a movable tongue block extending from said lower end face in a direction opposite to the open side, adapted to be connected to a support stand for a golf bag reclined from the vertical.

7. The golf bag bottom of claim 6, wherein the notches are V-shaped.

8. A golf bag comprising:

a first bottom base having an open top and one open side, formed of a first bottom portion having a substantially planar lower end face suitable for being placed on a ground, a first side frame extending vertically from the peripheral edge of said first bottom portion, partially enclosing said first bottom portion to form the open top and the one open side thereof, the side frame at the juncture of the open top with the open side having corners beveled away from the open side;

a second bottom base having an open top and one open side, formed of a second bottom portion having a substantially planar lower end face suitable for being placed on the ground, a second side frame extending vertically from the peripheral edge of said second bottom portion, partially enclosing said second bottom portion to form the open top and the one open side thereof, the top corners of said second side frame at the open side being beveled away from the open side; and a transitional part directly coupling said first and second bottom portions together at the open sides respectively, adapted to allow separation between said first and second bottom portions, whereby said second bottom portion may be angled with respect to said first bottom portion;

wherein said beveled corners of said first side frame and said second side frame form a notch on each end of the open sides, each apex of said notches acting as a hinge point thereby defining a horizontal pivot axis elevated above said first bottom portion, whereby a golf bag attached to said golf bag bottom may be reclined from the vertical with said first bottom portion placed on the ground and said second bottom portion forming an acute angle to the ground wherein said first bottom base further comprises a movable tongue block extending from said lower end face in a direction opposite to the open side, adapted to provide support to a golf bag;

a top frame;

a bag body connecting said top frame to said golf bag bottom;

a retractable support stand attached to said bag body; and at least one external support spring connecting said support stand to said movable tongue block of said golf bag bottom;

wherein said support stand is adapted to provide retractable support when said golf bag is reclined from the vertical.

* * * * *